United States Patent [19]

Takenaka et al.

[11] Patent Number: 4,685,866

[45] Date of Patent: Aug. 11, 1987

[54] VARIABLE DISPLACEMENT WOBBLE PLATE TYPE COMPRESSOR WITH WOBBLE ANGLE CONTROL UNIT

[75] Inventors: Kenji Takenaka; Masaki Ohta; Hiroaki Kayukawa, all of Kariya, Japan

[73] Assignee: Kabushiki Kaisha Toyoda Jidoshokki Seisakusho, Kariya, Japan

[21] Appl. No.: 856,760

[22] Filed: Apr. 28, 1986

Related U.S. Application Data

[63] Continuation-in-part of Ser. No. 839,908, Mar. 14, 1986.

[30] Foreign Application Priority Data

| | | | |
|---|---|---|---|
| Mar. 20, 1985 | [JP] | Japan | 60-56422 |
| May 2, 1985 | [JP] | Japan | 60-95093 |
| May 23, 1985 | [JP] | Japan | 60-111096 |
| Jun. 13, 1985 | [JP] | Japan | 60-129362 |

[51] Int. Cl.[4] ..... F04B 1/26

[52] U.S. Cl. ..... 417/222; 417/270

[58] Field of Search ..... 417/222, 270, 269

[56] References Cited

U.S. PATENT DOCUMENTS

| | | | |
|---|---|---|---|
| 4,037,993 | 7/1977 | Roberts | 417/222 |
| 4,174,191 | 11/1979 | Roberts | 417/222 |
| 4,428,718 | 1/1984 | Skinner | 417/222 |
| 4,480,964 | 11/1984 | Skinner | 417/222 |
| 4,526,516 | 7/1985 | Swain et al. | 417/222 |
| 4,586,874 | 5/1986 | Hiraga et al. | 417/222 |

*Primary Examiner*—Carlton R. Croyle
*Assistant Examiner*—Paul F. Neils
*Attorney, Agent, or Firm*—Burgess, Ryan & Wayne

[57] ABSTRACT

A variable displacement wobble plate type compressor with a variable angle non-rotary wobble plate, having a suction chamber for refrigerant before compression, a discharge chamber for refrigerant after compression, suction and discharge cylinder bores, pistons reciprocating in the cylinder bores, a crankcase receiving therein a drive and a wobble plate mechanism mounted about a drive shaft connectable to a rotary drive source, i.e., a vehicle engine, connected to the pistons to cause reciprocating motion of the pistons and capable of changing the wobble angle thereof, a first passageway for communicating the crankcase interior chamber with the discharge chamber, a control valve unit for closing and opening the first passageway, a second passageway for constantly communicating the crankcase interior chamber with the suction chamber to enable a constant extraction of the refrigerant from the crankcase interior chamber into the suction chamber, and a third passageway providing an additional fluid communication between the crankcase interior chamber and the suction chamber in accordance with a decrease in the wobbling angle of the drive and wobble plates, thereby permitting an additional extraction of the refrigerant gas from the crankcase interior chamber into the suction chamber when the compressor is in a small displacement operation.

9 Claims, 12 Drawing Figures

VARIABLE DISPLACEMENT WOBBLE PLATE TYPE COMPRESSOR WITH WOBBLE ANGLE CONTROL UNIT

CROSS-REFERENCE TO RELATED APPLICATION

This is a continuation-in-part application of copending U.S. patent application Ser. No. 839,908 filed Mar. 14, 1986.

BACKGROUND OF THE INVENTION

1. Field of the Invention

The present invention relates to a variable angle wobble plate type compressor with a unit for changing compressor displacement. More particularly, the present invention relates to a variable angle wobble plate type compressor including a suction chamber, a discharge chamber, and a crankcase, wherein a piston stroke is varied through a change in an inclination of the wobble plate from a fully inclined position to a substantially non-inclined position nearly vertical to a drive shaft of the compressor, which change is caused by a pressure difference between a suction pressure and a crankcase pressure, whereby the compression capacity of the compressor is changed over a wide range.

2. Description of the Related Art

A typical conventional variable displacement compressor applicable for an air conditioning system of a vehicle is disclosed in U.S. Pat. No. 4,428,718 to Skinner. This compressor is provided with a bellows in a suction chamber to detect suction pressure. When the suction pressure decreases below a predetermined value due to a decrease in a cooling load or due to a high-speed rotation of the compressor, the bellows is expanded according to the variation of balance between the suction pressure and atmospheric pressure to actuate a valve mechanism. A communication passage between the crankcase and suction chamber is then closed and a communication passage between a discharge chamber and the crankcase is opened, to increase the crankcase pressure so that the pressure difference between the crankcase pressure and suction pressure will be increased. As a result, a pistol stroke is reduced to reduce the inclination of a wobble plate which causes the piston to reciprocate, so that the suction pressure will be prevented from falling below a predetermined value, and the compressor displacement will be reduced.

However, when the suction pressure is temporarily decreased due to, for instance, a sudden acceleration, the bellows of the conventional variable displacement compressor mentioned above rapidly detects the change of suction pressure and actuates the valve mechanism, causing a high-pressure discharge gas to be sent into the crankcase and excessively increasing the crankcase pressure; although, in such a sudden acceleration, the piston stroke is automatically reduced according to the decrease of suction pressure, to start a small displacement operation without the need to increase the crankcase pressure. Due to the above, even if the revolution speed is decreased after the sudden acceleration operation, the pressure difference between the suction chamber and crankcase is small due to the reduction of the number of revolutions and the pressure in the suction chamber is increased by the insufficient displacement in the small displacement operation, so that the excessively heightened pressure in the crankcase can be reduced only gradually and the small displacement operation will be continued with the reduced piston stroke. As a result, the temperature in a vehicle cabin rises. To lower the temperature to an optimum value, the inclination of the wobble plate must be once returned to the maximum inclination, i.e., a delay occurs before the optimum temperature can be reached. Further, the bearing pressure at the shaft seal is increased because the crankcase pressure is excessively increased for every sudden acceleration, causing a problem in that the durability of the shaft seal mechanism is lowered.

In order to eliminate the above-mentioned problems of the conventional variable displacement wobble plate type compressor, U.S. patent application Ser. No. 839,908 to be assigned io the same assignee as the present patent application discloses a novel control means for controlling a compressor displacement of a variable displacement wobble plate type compressor, in which the pressure in the crankcase interior or chamber is kept substantially at a predetermined constant value during ordinary operation of the compressor, and the piston stroke of the compressor is controlled according to a pressure difference between the pressure in the crankcase interior, which is kept substantially at the constant value, and the suction pressure which varies according to a change in the cooling load, etc. The inventors of the present application have continued an investigation of the performance of a wobble angle controlling unit of a variable displacement wobble plate type compressor on the basis of the invention disclosed in the above-mentioned related application. That is, the present inventors have endeavored to develop a compressor of the type mentioned above, in which a return of the wobble plate from a fully inclined position thereof to the least inclined position thereof is smoothly carried out.

SUMMARY OF THE INVENTION

An object of the present invention is, therefore, to provide a variable displacement wobble plate type compressor with a wobble angle control unit improved so as to achieve a smooth return of the wobble plate from the least inclined position thereof to a fully inclined position thereof whereby the compressor starts to return from a small displacement operation to a large displacement operation thereof.

Another object of the present invention is to provide a variable displacement wobble plate type compressor capable of changing its displacement over a wide range from a very small to a large displacement.

A further object of the present invention is to provide a variable displacement compressor capable of being driven by a vehicle engine while preventing loss of a drive power.

In accordance with the present invention, there is provided a variable displacement wobble plate type compressor comprising: a suction chamber for a refrigerant; a plurality of cylinder bores arranged so as to surround an axial drive shaft and having therein associated reciprocatory pistons disposed so as to draw the refrigerant from the suction chamber and to then discharge the refrigerant after compression in the discharge chamber; a crankcase having defined therein a chamber communicating with the cylinder bores and containing therein a drive plate mounted in such a manner that it is capable of rotating with the axial drive shaft as well as changing in inclination thereof with respect to the axial drive shaft and a non-rotating wobble plate held by the drive plate; a plurality of connecting rods connecting between the wobble plate and pistons; a first passageway means for communicating the chamber of the crankcase with the discharge chamber; a first valve means arranged in the first passageway means, for opening and closing the first passageway means; a second passageway means for providing a first fluid communication between the chamber of the crankcase and the suction chamber; valve control means for controlling the operation of the first valve means in response to a change in fluid pressure in the chamber of the crankcase with respect to a predetermined pressure level, the valve control means moving the first valve means to a first position opening the first passageway means when pressure in the chamber of the crankcase is less than the predetermined pressure level, and to a second position closing the first passageway means when the pressure in the chamber of the crankcase is larger than the predetermined pressure level; a third passageway means arranged separately from the second passageway means, for providing a second variable fluid communication between the chamber of the crankcase and the suction chamber, the third passageway means including a portion thereof extending axially through the drive shaft and in constant communication with the suction chamber; and a movable means for closably opening the third passageway means at a position thereof adjacent to the chamber of the crankcase in direct relation to a decrease in the inclination of the drive and the wobble plates from a predetermined inclined position whereat the wobble plate is able to provide the pistons with the maximum reciprocatory strokes.

BRIEF DESCRIPTION OF THE DRAWINGS

Other objects, features and advantages of the present invention will be made more apparent from the ensuing description of the embodiments of the present invention with reference to the accompanying drawings, wherein.

DESCRIPTION OF THE PREFERRED EMBODIMENTS

Figure 1:
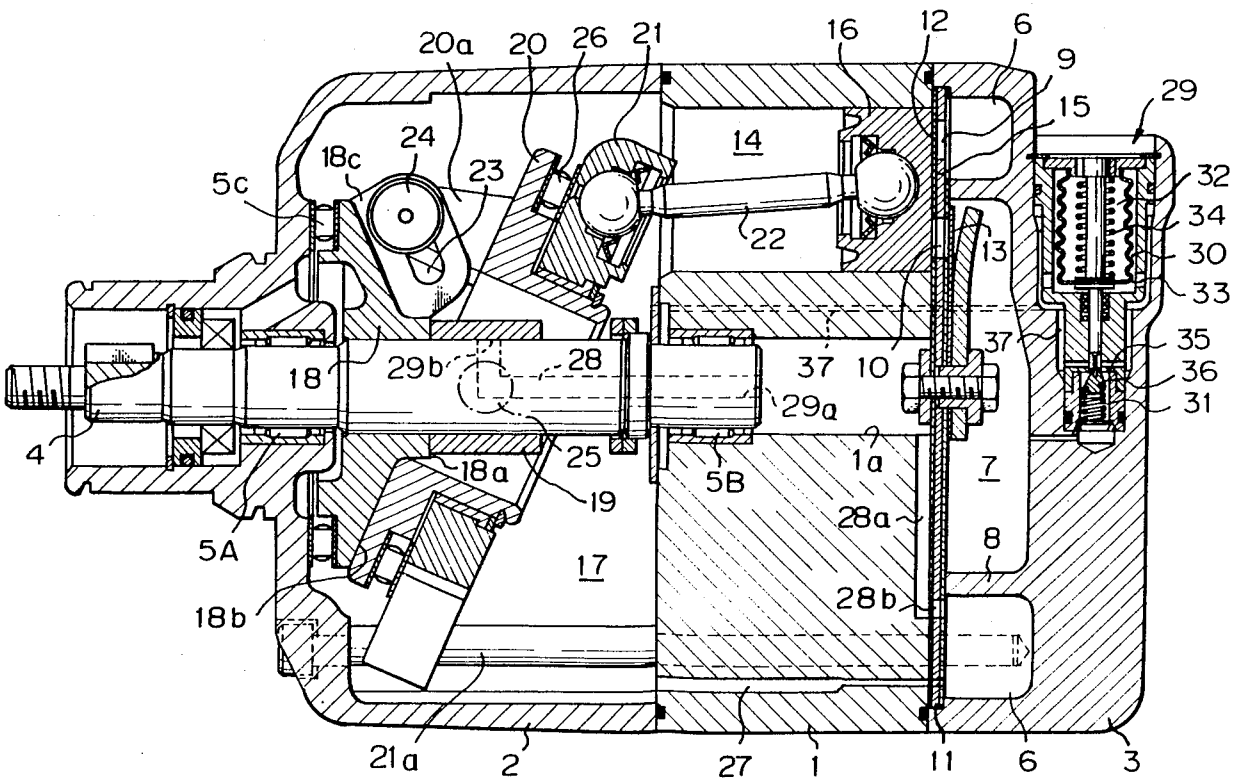
FIG. 1 is a vertical cross-sectional view of a variable displacement wobble plate type compressor with a wobble angle control unit according to a first embodiment of the present invention.

The constitutions and operation of embodiments of the present invention will now be described with reference to the accompanying drawings. It should be noted that throughout the drawings illustrating first through fifth embodiments of the present invention, identical and like parts or elements are designated by the same reference numerals.

Referring to FIG. 1 which illustrates a variable displacement compressor with a variable angle wobble plate according to a first embodiment of the present invention and applicable to an air conditioning system of a vehicle, a cylinder block 1 is provided on a right end face thereof with a valve plate 11 through which a rear housing or compressor head 3 is connected and fixed to the cylinder block 1 with an appropriate fastening means. The left end face of the cylinder block 1 is connected and fixed to a front housing or crankcase 2 having a bearing 5A for rotatably supporting a drive shaft 4 described later. The compressor head 3 is formed therein with an annular suction chamber 6 and a central discharge chamber 7 which are concentrically arranged and separated from one another by a partition wall 8. The suction and discharge chambers 6 and 7 are connected with an external refrigerating circuit of the air conditioning system through an inlet port (not shown) and an outlet port (not shown), respectively. Also, the suction and discharge chambers 6 and 7 are fluidly connectable to a later described compression chamber 15 of each of a plurality of cylinder bores 14 formed in the cylinder block 1 via a suction port 9 and a discharge port 10, respectively. The suction port 9 is closed by a suction valve 12 which is opened when an associated piston 16 carries out a suction stroke thereof in the cylinder bore 14. The discharge port 10 is closed by a discharge valve 13 which is opened when the associated piston 16 carries out a compression stroke thereof in the cylinder bore 14. The cylinder block 1 has at its center a bearing 5B mounted therein so as to be coaxial and to cooperate with the afore-mentioned bearing 5A for rotatably supporting the drive shaft 4. The cylinder block 1 also has the afore-mentioned cylinder bores 14 circumferentially arranged so as to surround the bearing 5B. In each of the cylinder bores 14, the afore-mentioned piston 16 is slidably and reciprocally fitted so as to define the afore-mentioned compression chamber 15 on the rear side of the cylinder block 1. Thus, the compression chamber 15 is alternately connected with the afore-mentioned suction chamber 6 and discharge chamber 7 via suction and discharge ports 9 and 10 in response to the reciprocating motion of the piston 16.

The crankcase 2 has therein a cylindrical chamber 17 which is communicated with all of the cylinder bores 14 of the cylinder block 1. The cylindrical chamber 17 receives therein the afore-mentioned drive shaft 4 axially arranged in the chamber 17 between the above-mentioned pair of bearings 5A and 5B. An outer end of the drive shaft 4 is outwardly extended over the front end of the crankcase 2 so that it is connectable to a vehicle engine (not shown) via an appropriate transmission unit and a clutch device. On the drive shaft 4 is mounted a drive element 18 referred to as a lug plate throughout all embodiments of the present invention. The lug plate 18 having a generally round configuration is rotatably held by a thrust bearing 5C against a front inner wall of the crankcase 2 and is able to rotate with the drive shaft 4. The lug plate 18 is provided, on its inner end, with an end face 18*a* with which a later-described sleeve element 19 is able to come in contact during the large displacement operation of the compressor. The lug plate 18 is also provided, around the end face 18*a*, with an inclined end face 18*b* with which a drive plate 20 is able to come in contact during the wobbling thereof, and a support arm 18*c* for supporting the drive plate 20. The support arm 18*c* and the inclined end face 18*b* are arranged so as to be circumferentially spaced apart from one another by an angle of approximately 180 degrees. The drive plate 20 formed as an annular member enclosing the drive shaft 4 is supported by the support arm 18*c* so that it is able to wobble about an axis vertical to the axis of the drive shaft 4. That is, the drive plate 20 is able to wobble so as to incline with respect to a plane perpendicular to the axis of the drive shaft 4. The support arm 18*c* is formed with an arcuate hole 23 of which the center of curvature passes through points where a later-described wobble plate 21 and connecting rods 22 are pivotally connected together via ball and socket joints during the rotation of the lug plate 18. On the other hand, the drive plate 20 has a bracket 20*a* extending toward and mated with the support arm 18*c* of the lug plate 18. The bracket 20*a* and the support arm 18*c* are operatively connected together by means of a guide pin 24 fixed to the bracket 20*a* and movably engaged in the arcuate hole 23 of the support arm 18*c* so that the drive plate 20 is permitted to wobble against the lug plate 18 while it is rotating with the drive shaft 4. The sleeve element 19 which is slidably mounted on the drive shaft 4 is connected to the drive plate 20. That is, the cylindrical sleeve element 19 has a pair of diametrically opposed pivots 25 on which the drive plate 20 is pivotally mounted. Therefore, the sleeve element 19 slides along the drive shaft 4 in association with the wobbling motion of the drive plate 20. The drive plate 20 holds thereon a non-rotating wobble plate 21 by means of a thrust bearing 26. The wobble plate 21 is permitted to carry out only a wobbling motion together with the drive plate 20 and is formed as an annular element enclosing the drive shaft 4. The non-rotating wobble plate 21 is operatively connected with the afore-mentioned respective pistons 16 by means of respective connecting rods 22 and ball and socket joints provided on both ends of each connecting rod 22. At this stage, it should be noted that the connections between the wobble plate 21 and respective pistons 16 are established in such a manner that each of the pistons 16 is brought into its top dead center (i.e., the rearmost position in each cylinder bore 14) by the wobble plate 21 via the associated connecting rod 22 when the support arm 18*c* of the lug plate 18 is rotated to a position where the arm 18*c* is in axial alignment with each of the cylinder bores 14. The wobbling motion of the non-rotating wobble plate 21 is guided by a guide pin 21*a* fixedly and axially extended through the crankcase 2, cylinder block 1, and the compressor head 3.

The cylinder block 1 is formed with a fluid passageway 27 in the form of a through-bore extending axially so as to provide a constant fluid communication between the suction chamber 6 of the compressor head 3 and the chamber 17 of the crankcase 2.

Figure 2:
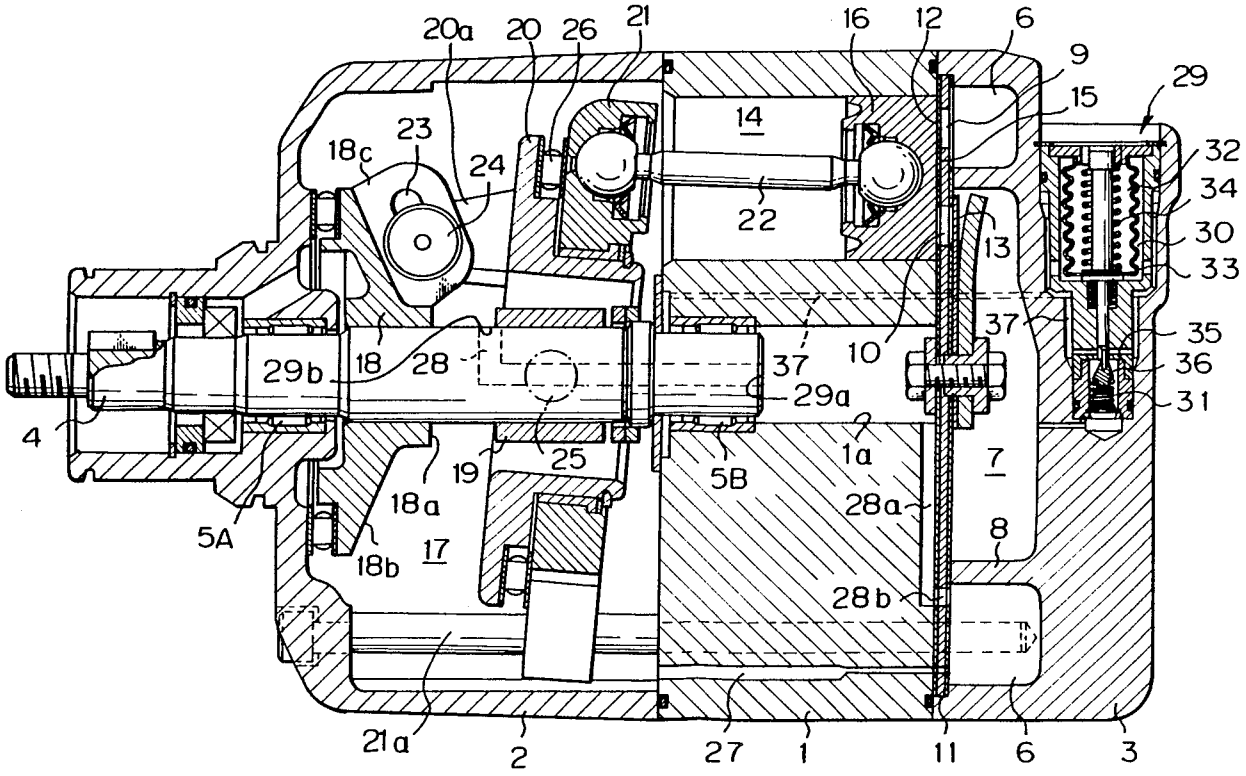
FIG. 2 is an identical cross-sectional view of the compressor of FIG. 1, illustrating a state where the wobble plate is moved to a substantially non-inclined position from an inclined position shown in FIG. 1.

The drive shaft 4 is formed with a fluid passageway 28 having a first open end 29*a* opening toward a central bore 1*a* of the cylinder block 1 and a second open end 29*b* opening toward the chamber 17 of the crankcase 2. The fluid passageway 28 is provided as a bypass for fluidly communicating the chamber 17 of the crankcase 2 with the suction chamber 6. Therefore, the bypass passageway 28 is connected to the suction chamber 6 by way of the central bore 1*a* of the cylinder block 1, a radial passageway 28*a* recessed in the rear end face of the cylinder block 1, and a through-bore 28*b* formed in the rear valve plate 11 for connecting the radial passageway 28*a* to the suction chamber 6. At this stage, it should be understood that the second open end 29*b* of the bypass passageway 28 is arranged in the circumference of the drive shaft 4 so as to be closed and opened by the sleeve element 19 sliding along the drive shaft 4. That is to say, the second open end 29*b* is closed when the angle of inclination of the drive and wobble plates 20 and 21 is large, and is opened when the inclination angle of both plates 20 and 21 is small. FIG. 1 illustrates the closed state of the second open end 29*b* of the bypassing passageway 28, and FIG. 2 illustrates the open state of the same end 29*b* of the bypass passageway 28.

The compressor head 3 is provided with a control valve 29 for changing the wobble angle of the drive and wobble plate 20 and 21 through controlling a pressure level within the crankcase chamber 17. The control valve 29 includes a first chamber 30 communicated with the crankcase chamber 17 for sensing the pressure in the latter chamber 17, and a second chamber 31 communicated with the discharge chamber 7 for sensing the discharge pressure in the latter chamber 7. The first and second chambers 30 and 31 are separated from one another by a movable valve element 36. The first chamber 30 receives therein a bellows member 33 which has therein an atmospheric chamber 32 communicated with the atmosphere. Within the atmospheric chamber 32, there is provided a coil spring 34 wound around an appropriate support rod and constantly urging the bellows member 33 toward its extended position. The bellows member 33 is connected to a valve rod having a lower end thereof connected to the above-mentioned valve element 36. The valve element 36 is located at a valve seat 35 formed between the first and second chambers 30 and 31. The first chamber 30 is communicated with a pressure supply passageway 37 which extends from the valve seat 35 to the crankcase chamber 17 through the compressor head 3 and the cylinder block 1. The pressure supply passageway 37 operates so as to provide a fluid communication between the discharge chamber 7 and the crankcase chamber 17 when the valve element 36 is moved from the valve seat 35 against spring pressure exerted by a spring arranged in the second chamber 31. That is, the pressure supply passageway 37 permits the compressed gas in the discharge chamber 7 to flow into the crankcase chamber 17, thereby raising the pressure level within the crankcase chamber 17.

Figure 4:
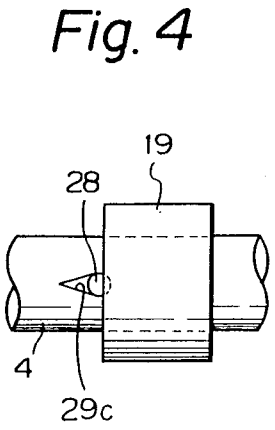
FIG. 4 is a partial enlarged plan view of a part of a drive shaft and a sleeve element assembled in the compressor of FIG. 3.
Figure 3:
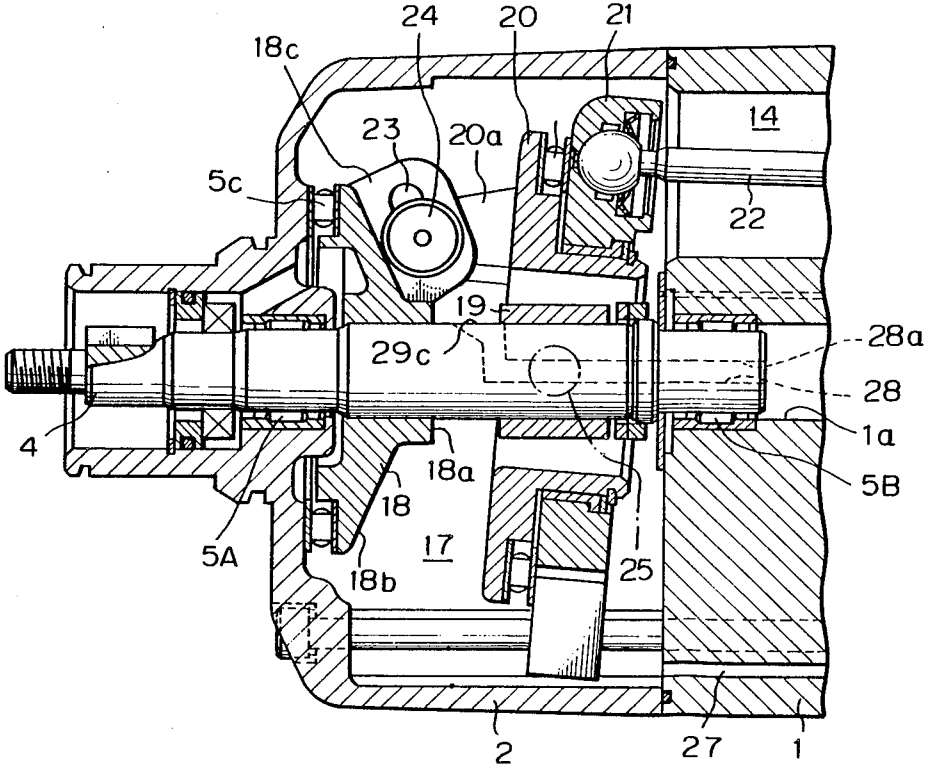
FIG. 3 is a partial vertical cross-sectional view of a variable displacement wobble plate type compressor with a wobble angle control unit according to a second embodiment of the present invention.

FIGS. 3 and 4 illustrate a variable displacement compressor according to a second embodiment of the present invention. The compressor of the second embodiment is different from that of the first embodiment of FIGS. 1 and 2 in that a first open end 29*c* of the bypass passageway 28 opening toward the crankcase chamber 17 is axially elongated so that the amount of the opening area of the open end 29*c* is gradually increased in response to the sliding of the sleeve element 19 in the rearward direction. That is, in accordance with decrease in the angle of inclination of the drive and wobble plates 20 and 21, the fluid communication between the crankcase chamber 17 and the bypass passageway 28, i.e., the suction chamber 6, is gradually increased. The other portions and elements of the compressor of FIGS. 3 and 4 are identical with those of the compressor of FIGS. 1 and 2.

Figure 5:
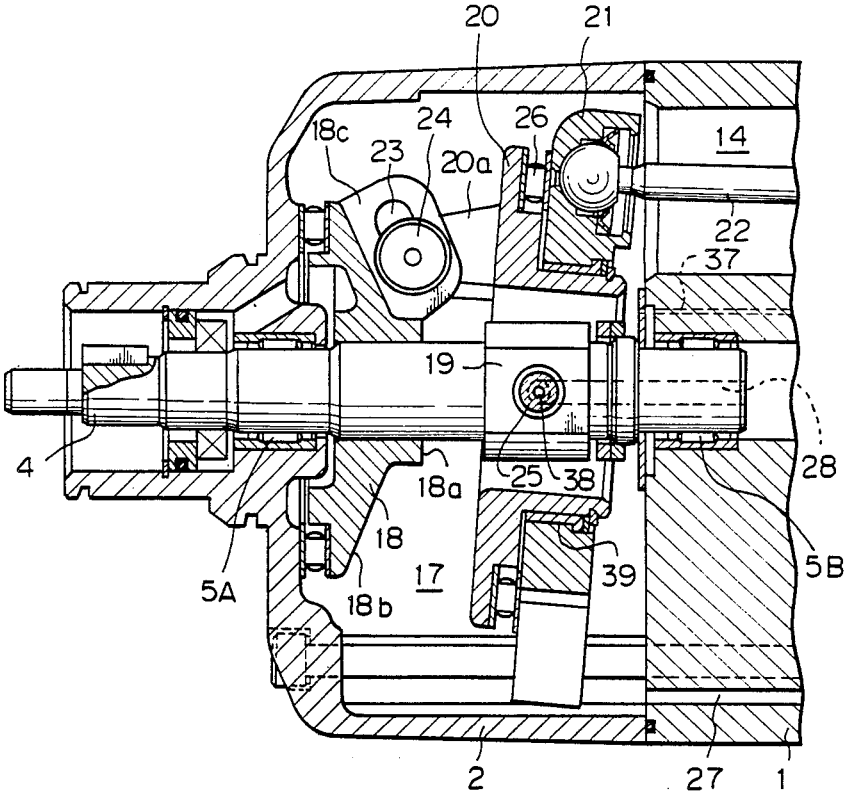
FIG. 5 is a partial vertical cross-sectional view of a variable displacement wobble plate type compressor with a wobble angle control unit according to a third embodiment of the present invention.
Figure 6A:
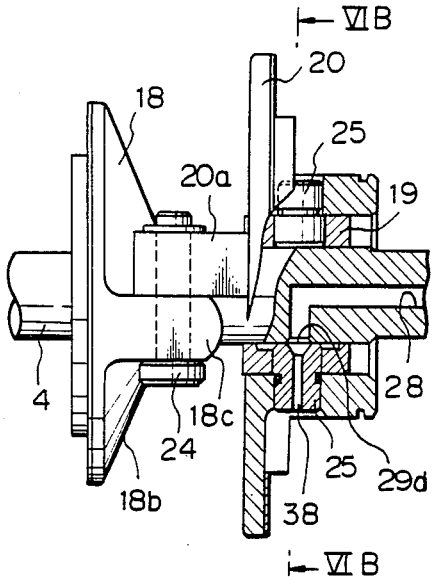
FIG. 6A is a partial plan view, in part cross section, of a part of a drive plate mounted on a drive shaft and a sleeve element assembled in the compressor of FIG. 5.
Figure 6B:
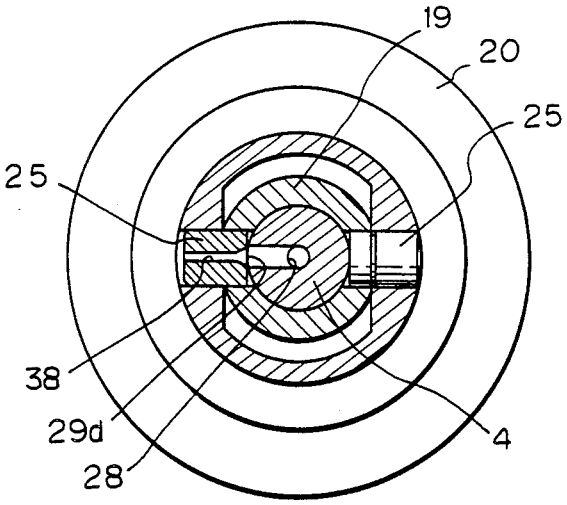
FIG. 6B is a cross-sectional view taken along the line VIB—VIB in FIG. 6A.

FIGS. 5, 6A and 6B illustrate a variable displacement compressor of the third embodiment, in which a second open end 29*d* of the bypass passageway 28 is arranged in such a manner that when the drive and wobble plates 20 and 21 are brought to a substantially non-inclined position, the second open end 29*d* is communicated with the crankcase chamber 17 through a central relief port 38 formed in one of the pivots 25 connecting the drive plate 20 and the sleeve element 19. The relief port 38 is opened toward the crankcase chamber 17 through a bore formed in a portion of the drive plate 20 on which a slide bearing 39 for the wobble plate 21 is mounted. When the drive and wobble plates 20 and 21 are sufficiently inclined, the central relief port 38 of the pivot 25 is not in alignment with the open end 29*d* of the bypass passageway 28. Thus, a fluid communication between the crankcase chamber 17 and the suction chamber 6 is prevented. On the other hand, when the drive and wobble plates 20 and 21 are moved to their non-inclined position, the sleeve element 19 and the pivot 25 come in alignment with the open end 29*d* of the bypassing passageway 28. Therefore, a fluid communication is established between the crankcase chamber 17 and the suction chamber 6 of the compressor head 3. The other portions and elements of the compressor of the third embodiment of FIGS. 5 through 6B are identical with those of the first embodiment.

The operation of the compressor according to the first through third embodiments of the present invention will now be described hereunder.

When the operation of the compressor is stopped, the pressure in the suction chamber 6 and that in the crankcase chamber 17 are usually balanced with one another at a level higher than a preset pressure level. Therefore, a high pressure of the crankcase chamber 17 prevails in the first chamber 30 of the control valve 29 through the pressure supply passageway 37. Accordingly, the bellows member 33 is contracted against the atmospheric pressure and the pressure of the coil spring 34, and the contracted state of the bellows member 33 is maintained until the compressor is restarted. When the bellows member 34 is contracted, the valve element 36 is moved toward and closes the valve seat 35, so that the communication between the second chamber 31 of the control valve 29 and the pressure supply passageway 37, i.e., the communication between the discharge chamber 7 of the compressor head 3 and the crankcase chamber 17, is interrupted.

When the operation of the compressor is started by connecting the drive shaft 4 to the vehicle engine via a clutch device, such as a solenoid clutch, rotation of the drive plate 20 is begun. As a result, the suction pressure Ps prevailing in the suction chamber 6 is temporarily and rapidly dropped. Accordingly, a pressure difference appears between the crankcase pressure Pc prevailing in the crankcase chamber 17 and the suction pressure Ps, and the drive plate 20 as well as the wobble plate 21 are rotated for a while at a small inclination position due to the pressure difference. That is, the reciprocating stroke of the pistons 16 is kept small. However, during the continuation of the operation of the compressor, the refrigerant in the crankcase chamber 17 gradually flows out into the suction chamber 6 through the fluid passageway 27. Therefore, the pressure difference between the crankcase pressure Pc and the suction pressure Ps is reduced, causing the drive and wobble plates 20 and 21 to be restored to a large inclined position. That is, the wobbling angle of both plates 20 and 21 becomes large, and the reciprocating stroke of the pistons 16 becomes large. Accordingly, the displacement of the compressor is increased to the maximum, i.e., a full displacement operation of the compressor.

When the compressor carries out the full displacement operation, a large amount of refrigerant containing therein a sufficient amount of lubricating oil component is circulated through the refrigerating circuit including the compressor. Therefore, in the compressor, the refrigerant drawn into the cylinder bores 14 of the cylinder block 1 applies a high sealing effect between the walls of the cylinder bores 14 and the circumferences of the pistons 16, restricting the flow of the blowby gas from the compression chambers 15 of the cylinder bores 14 to the crankcase chamber 17. As a result, due to the provision of the constant fluid passageway 27, the crankcase pressure Pc is maintained at a constant level equivalent to the level of the suction pressure Ps.

When the full displacement operation of the compressor is continued for an appropriate period of time, the vehicle compartment to be air-conditioned is cooled, and the cooling load applied to the compressor is reduced. In response to a reduction in the cooling load, the suction pressure of the refrigerant sent from the outer refrigerating circuit into the suction chamber 6 of the compressor is lowered. Thus, when a pressure difference occurs between the suction pressure Ps and the crankcase pressure Pc of the crankcase chamber 17, and when the pressure difference increases, the angle of inclination of the drive and wobble plates 20 and 21 is decreased, so that the reciprocating stroke of the pistons 16 is also reduced. As a result, the displacement of the compressor becomes small, i.e., a small displacement operation of the compressor is effected.

At this stage, while the small displacement operation of the compressor continues, the amount of the refrigerant circulating through the refrigerating circuit is kept small. As a result, the sealing effect applied by the lubricating oil component to a clearance between the wall of the cylinder bores 14 and the circumference of the reciprocating pistons 16 becomes insufficient. Thus, the blowby gas flowing from the compression chambers of respective cylinder bores 14 into the crankcase chamber 17 increases. The increase in the flow amount of the blowby gas then causes an increase in the pressure Pc in the crankcase chamber 17, since the fluid passageway 27 permitting leakage of the refrigerant gas from the chamber 17 to the suction chamber 6 is not able to completely compensate for the pressure increase in the crankcase chamber 17. However, it should be appreciated that, in accordance with the present invention, when the small displacement operation of the compressor takes place, the drive and wobble plates 20 and 21 are moved to their small inclination position while being accompanied by the sliding movement of the sleeve element 19 in the direction to open the open end 29*b*, 29*c*, or 29*d* of the bypass passageway 28. As a result, an excessive part of the refrigerant gas in the crankcase chamber 17 is allowed to flow through the bypass passageway 28, the radial passageway 28*a*, and the through-bore 28*b* into the suction chamber 6. Therefore, a pressure increase in the crankcase chamber 17 due to the blowby gas can be avoided, and accordingly, a predetermined constant crankcase pressure Pc is always maintained. This means that control of the wobble angle of the drive and wobble plates 20 and 21 of the compressor from a small inclination or a non-inclination to a large inclination, and vice versa, is easily achieved by the control valve 29. That is to say, return of the operating condition of the compressor from the small displacement state to the full displacement state can be smoothly carried out.

Figure 7:
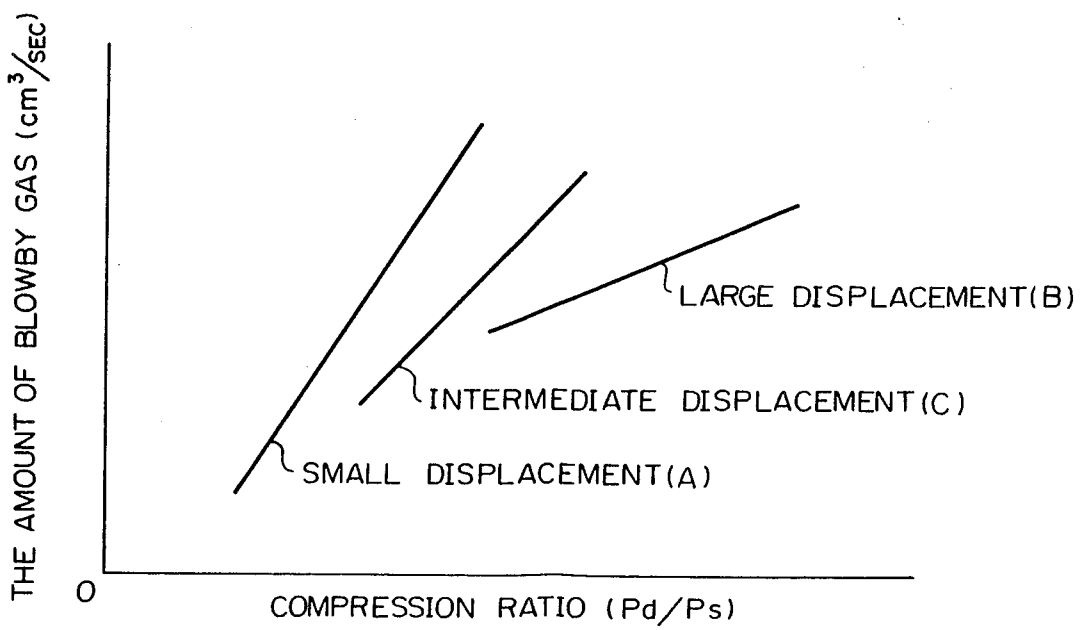
FIG. 7 is a graph indicating the relationship between the compression ratio of a compressor of the present invention and the amount of blowby gas within the compressor.

FIG. 7 is a graph illustrating a relationship between the compression ratio (Pd/Ps) of the compressor of the present invention and the amount of blowby gas. From FIG. 7, it will be understood that, in the small displacement operation of the compressor, the amount of blowby gas flowing from the compression chambers of the cylinder bores to the crankcase chamber varies in response to an increase in the compression ratio at a rate (see line "A" in FIG. 7) larger than in the case of the large displacement operation (see line "B" in FIG. 7). In this connection, according to the present invention, the bypass gas in the crankcase chamber 17 can return to the suction chamber 6 through not only the constant passageway 27 but also through the bypass passageway 28. Thus, the operation of the compressor at an extremely small displacement can be realized. Line "C" in FIG. 7 indicates the case of the intermediate displacement operation of the compressor.

With the embodiment of FIGS. 3 and 4, the open end 29*c* of the bypass passageway 28 is formed so that its opening area is gradually increased in response to the sliding movement of the sleeve element 19. Therefore, it is able to increase the flow amount of the excessive part of the refrigerant gas from the crankcase chamber 17 to the suction chamber 6 in proportion to a decrease in the angle of inclination of the drive and wobble plates 20 and 21 (i.e., a decrease in the wobbling angle of the drive and wobble plates 20 and 21). That is to say, the flow amount of the refrigerant gas from the crankcase chamber 17 to the suction chamber 6 through the bypass passageway 28 is adjusted in relation to the change in the wobbling angle of the drive and wobble plates 20 and 21. Therefore, the smooth return of the compressor from the small displacement operation to the large displacement operation is further ensured.

With the embodiment of FIGS. 5 through 6B, it should be noted that the excessive part of the refrigerant gas in the crankcase chamber 17 returns to the suction chamber 6 through the central relief port 38 and the bypass passageway 28. Therefore, prior to the entering of the refrigerant into the port 38, the refrigerant containing therein a lubricating oil is able to lubricate the thrust bearing 26 intervened between the drive and wobble plates 20 and 21. This lubrication of the thrust bearing 26 is one of the important advantages acquired by the present invention.

Another important advantage acquired by the present invention resides in the fact that by the provision of the bypass passageway 28 for permitting the excessive part of the refrigerant gas in the crankcase chamber to flow out into the suction chamber, the drive and wobble plates 20 and 21 for causing the reciprocation of the pistons 16 are able to change their inclination to a substantially non-inclined position thereof. Thus, it is ensured that the compressor operation is changed over a wide range of displacement from the full displacement operation to an extremely small displacement operation.

The above-described first through third embodiments of the present invention operate by controlling the opening and closing of the open end of the bypass passageway 28 by the use of the sliding movement of the sleeve element 19 mounted on the drive shaft 4 of the compressor.

FIGS. 8 through 11 illustrate fourth and fifth embodiments of the present invention, wherein the control of the opening and closing of the open end of the bypass passageway 28 is accomplished by the use of the drive plate 20.

Figure 8:
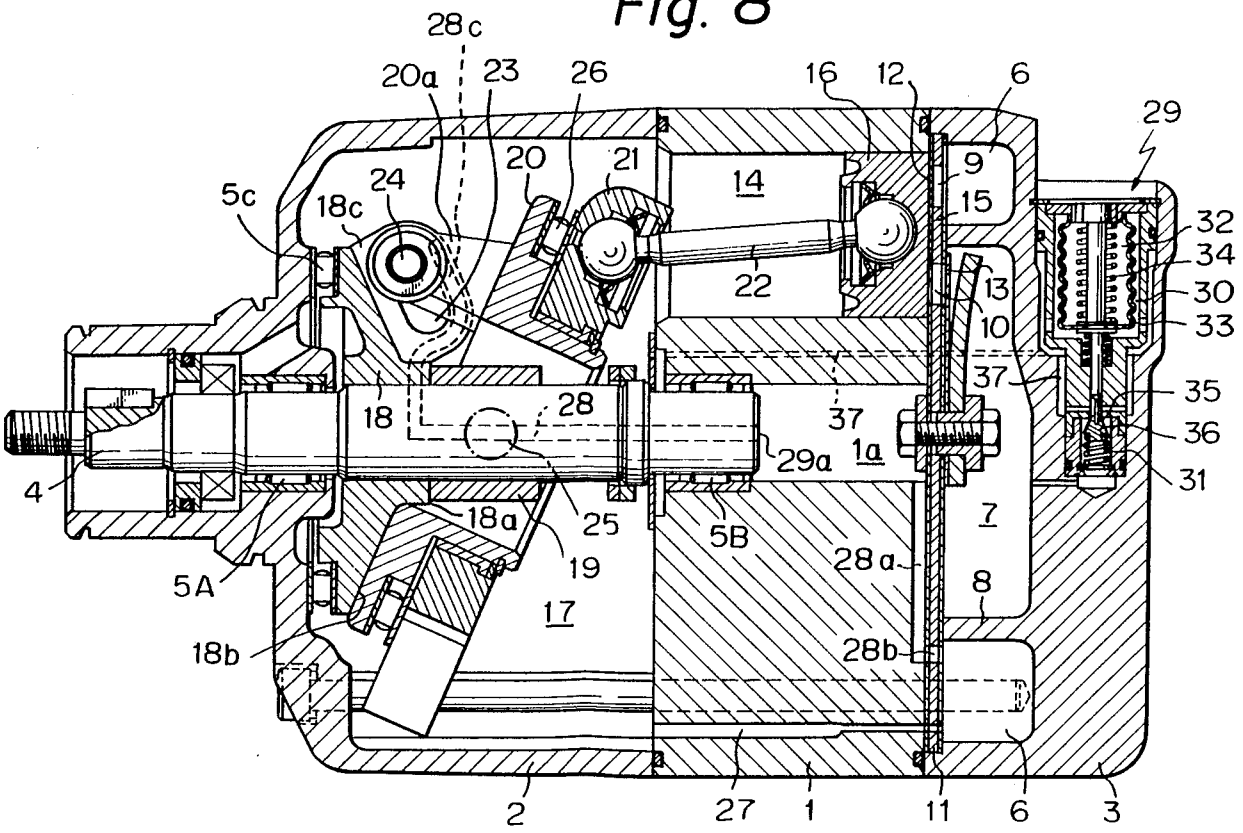
FIG. 8 is vertical cross-sectional view of a variable displacement wobble plate type compressor with a wobble angle control unit according to a fourth embodiment of the present invention.
Figure 9:
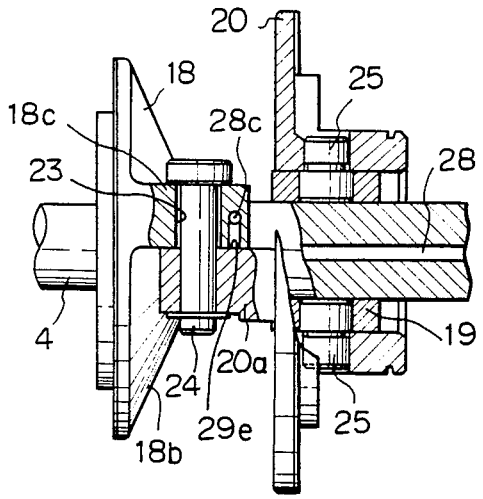
FIG. 9 is a partial plan view, in part cross section, of a lug plate and a drive plate assembled in the compressor of FIG. 8.
Figure 10:
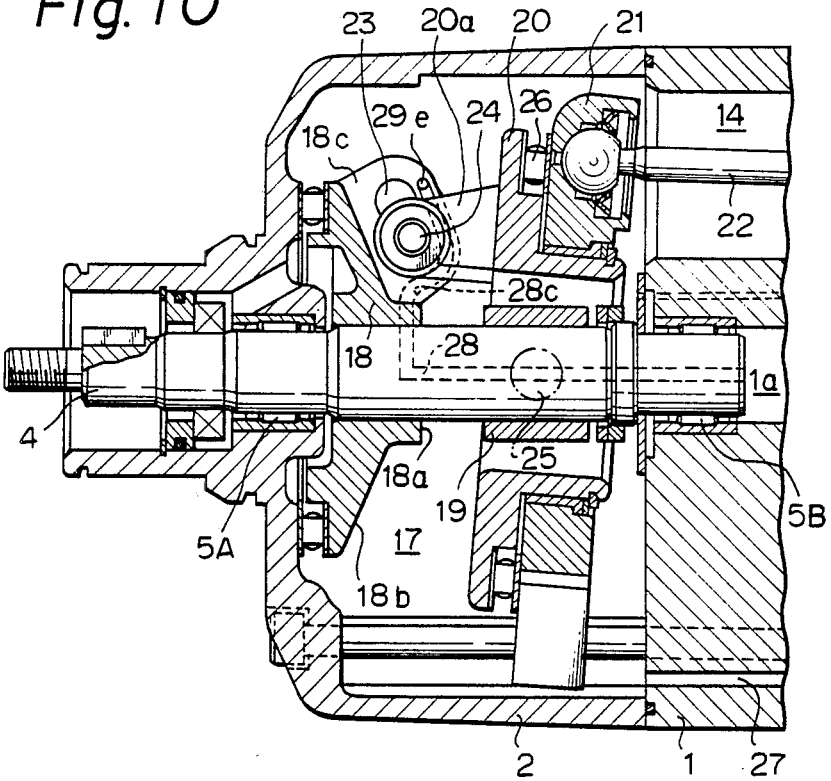
FIG. 10 is a partial and identical cross-sectional view of the compressor of FIG. 9, illustrating a different operating state where the wobble plate is moved to the minimum inclined position from an inclined position shown in FIG. 9.

With the fourth embodiment of the present invention illustrated in FIGS. 8 through 10, the following description will be provided for explaining the construction and operation of the compressor different from those of the afore-described three embodiments.

Referring to FIGS. 8 through 10, the compressor of the fourth embodiment of the present invention is different from that of the previous embodiments in that the bypass passageway 28 extends through the drive shaft 4 and the lug plate 18*c*. That is, the bypass passageway 28 includes a curved passageway 28*c* extending inside the support arm 18*c* of the lug plate 18. As illustrated in FIG. 9, the curved passageway 28*c* has an open end 29*e* opening in one of the lateral faces of the support arm 18*c*, i.e., in the face in slidable contact with the face of the bracket 20*a* of the drive plate 20. Therefore, the open end 29*e* of the curved passageway 28*c* is openably closed by the bracket 20*a* of the drive plate 20.

When the drive plate 20 is at a large inclined position, the open end 29*e* is closed by the support arm 20*a* of the drive plate 20 as shown in FIG. 8.

On the other hand, when the angle of inclination of the drive plate 20 from a plane perpendicular to the axis of the drive shaft 4 is decreased, the open end 29*e* of the curved passageway 28 is opened as shown in FIG. 10. As a result, since the curved passageway 28*c* is fluidly and constantly connected to the bypass passageway 28, a fluid communication between the crankcase chamber 17 and the suction chamber 6 is established via the central bore 1*a* of the cylinder block 1, the radial passageway 28*a*, and the through-bore 28*b* of the valve plate 11. It should be understood that the control valve 29 of this embodiment has an identical construction with that of the embodiment of the first through third embodiments.

Figure 11:
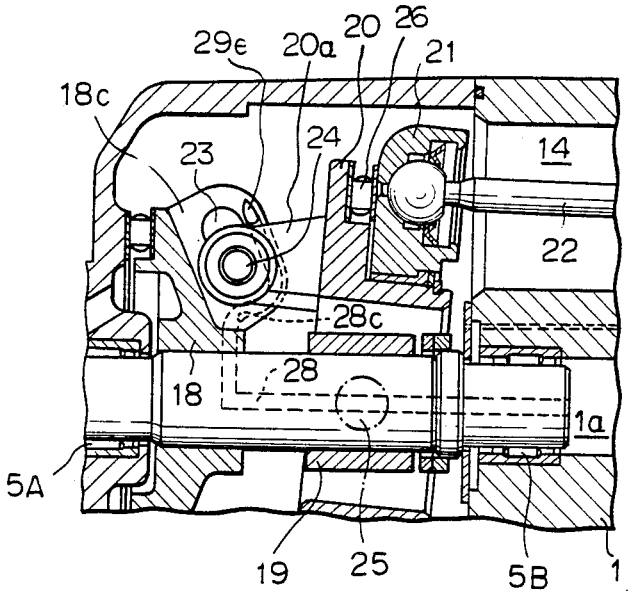
FIG. 11 is a partial cross-sectional view of a variable displacement wobble plate type compressor according to a fifth embodiment of the present invention.

FIG. 11 illustrates a fifth embodiment of the present invention, which is different from the fourth embodiment in that the curved passageway 28*c* extending inside the support arm 18*c* of the lug plate 18 is provided with an open end 29*f*. The open end 29*f* is formed in such a manner that the opening area thereof is gradually extended from the outer periphery of the support arm 18*c* toward the center of that arm 18*c*. That is to say, in accordance with a reduction in the angle of inclination of the drive plate 20, the opening area of the open end 29*f* of the curved passageway 28 increases. Therefore, as stated in the second embodiment of FIGS. 3 and 4, it is possible to adjust the extent of the fluid communication between the crankcase chamber 17 and the suction chamber 6 in proportion to a decrease in the angle of inclination of the drive plate 20. The other portion of the fifth embodiment is identical with the fourth embodiment of FIGS. 8 through 10.

It should be understood that the compressor according to the fourth and fifth embodiments can enjoy the same advantages exhibited by the compressor of the first through third embodiments.

Throughout the first to fifth embodiments of the present invention, it should be understood that, since the compressor of the present invention can be operated at a wide displacement range from the extremely small displacement state to the full displacement state, the compressor displacement can be always set at an optimum condition in accordance with a change in the refrigerating load applied to the refrigerating system. Thus, the compressor can be driven by a vehicle engine without a loss of engine power.

It should be further understood that various modifications and variations will occur to a person skilled in the art without departing from the scope of the appended claims.

We claim:

1. A variable displacement wobble plate type compressor comprising:

a suction chamber for a refrigerant; a plurality of cylinder bores arranged so as to surround an axial drive shaft and having therein associated reciprocatory pistons disposed so as to draw the refrigerant from the suction chamber and to then discharge the refrigerant after compression in the discharge chamber; a crankcase having defined therein a chamber communicating with the cylinder bores and containing therein a drive plate mounted in such a manner that it is capable of rotating with the axial drive shaft as well as changing an inclination thereof with respect to the axial drive shaft and a non-rotating wobble plate held by the drive plate; a plurality of connecting rods connected between the wobble plate and pistons; a first passageway means for communicating said chamber of said crankcase with said discharge chamber; a first valve means arranged in said first passageway means, for opening and closing said first passageway means; a second passageway means for providing a first constant fluid communication between said chamber of said crankcase and said suction chamber; valve control means for controlling the operation of said first valve means in response in a change in fluid pressure in said chamber of said crankcase with respect to a predetermined pressure level, said valve control means moving said first valve means to a first position opening said first passageway means when pressure in said chamber of said crankcase is less than said predetermined pressure level, and to a second position closing said first passageway means when said pressure in said chamber of said crankcase is larger than said predetermined pressure level; a third passageway means arranged separately from said second passageway means, for providing a second variable fluid communication between said chamber of said crankcase and said suction chamber, said third passageway means including a portion thereof extending axially through said drive shaft and constantly communicated with said suction chamber, and; a movable means for closably opening said third passageway means at a position thereof adjacent to said chamber of said crankcase in direct relation to a decrease in said inclination of said drive and said wobble plates from a predetermined inclined position whereat said wobble plate is able to provide said pistons with the maximum reciprocatory strokes.

2. A variable displacement wobble plate type compressor as claimed in claim 1, wherein said third passageway means comprises an open end located in a circumference of said drive shaft so as to open toward said chamber of said crankcase, and wherein said movable means comprises an annular sleeve element mounted on said drive shaft so as to axially slide from a first position closing said open end of said third passageway means to a second position apart from and permitting opening of said open end of said third passageway means, said annular sleeve element being operatively connected to said drive plate so as to slide from said first position thereof to said second position thereof in response to said decrease in inclination of said drive and wobble plates.

3. A variable displacement wobble plate type compressor as claimed in claim 2, wherein said open end of said third passageway means is an axially extended open end cooperating with said annular sleeve element so that said fluid communication between said chamber of said crankcase and said suction chamber is gradually increased during movement of said annular sleeve element from said first position to said second position.

4. A variable displacement wobble plate type compressor as claimed in claim 2, wherein said third passageway means further comprises an axial through-bore centrally formed in said cylinder block, a radial passageway formed in an axial end face of said cylinder block so as to be fluidly connected to said axial through-bore and said suction chamber.

5. A variable displacement wobble plate type compressor as claimed in claim 2, wherein said sleeve element has a pair of connecting pins about which said drive plate is mounted so as to wobble with said drive plate, one of said connecting pins being formed with a through-port capable of being in alignment with said open end of said third passageway in response to axial slide of said sleeve element caused by said decrease in said inclination of said drive and wobble plates, said through-port capable of connecting said third passageway to said crankcase chamber upon being aligned with said open end of said third passageway thereby permitting extraction of said refrigerant from said crankcase chamber into said suction chamber.

6. A variable displacement wobble plate type compressor as claimed in claim 5, wherein said through-port of said one of said connecting pins opens toward said chamber of said crankcase at a position adjacent to a bearing means via which said wobble plate is held by said drive plate.

7. A variable displacement wobble plate type compressor as claimed in claim 1, further comprising a support means arranged on said drive shaft to b.e rotatable therewith for wobblingly supporting said drive plate on which said wobble plate is non-rotatably held, said support plate being formed with a lug-shaped support arm having a arcuate hole in which a guide pin fixed to a bracket of said drive plate is movably engaged, said lug-shaped support arm being provided thereinside with a fourth fluid passageway means constantly fluidly communicated with said third passageway means and having an open end opening toward said chamber of said crankcase, said bracket of said drive plate being arranged so as to closably open said open end of said fourth fluid passageway means in direct relation to a decrease in said inclination of said drive and wobble plates.

8. A variable displacement wobble plate type compressor as claimed in claim 7, wherein said open end of said fourth fluid passageway means has an opening area capable of being increased by said bracket of said drive plate in response to said decrease in said inclination of said drive and wobble plates.

9. A variable displacement wobble plate type compressor as claimed in claim 7, wherein said lug-shaped support arm of said support means and said bracket of said drive plate are in face to face contact with one another.

* * * * *